United States Patent [19]

Devillard

[11] 4,067,674

[45] Jan. 10, 1978

[54] FURNACE FOR THE PRODUCTION OF SPHERICAL PARTICLES

[75] Inventor: Jacques Devillard, Saint Ismier, France

[73] Assignee: Commissariat a l'Energie Atomique, Paris, France

[21] Appl. No.: 746,063

[22] Filed: Nov. 30, 1976

[30] Foreign Application Priority Data

Dec. 9, 1975 France ..... 75.37625

[51] Int. Cl.[2] ..... B22D 23/08

[52] U.S. Cl. ..... 425/8; 264/8

[58] Field of Search ..... 425/8; 264/8

[56] References Cited

U.S. PATENT DOCUMENTS

| | | | |
|---|---|---|---|
| 2,439,772 | 4/1948 | Gow | 425/8 X |
| 2,439,776 | 4/1948 | Klein et al. | 425/8 |
| 3,099,041 | 7/1963 | Kaufmann | 425/8 X |
| 3,196,192 | 7/1965 | Vruggink et al. | 425/8 X |
| 3,249,657 | 5/1966 | Russo | 425/8 X |
| 3,721,511 | 3/1973 | Schlienger | 425/8 |
| 3,963,812 | 6/1976 | Schlienger | 425/8 X |

*Primary Examiner*—Robert L. Spicer, Jr.

*Attorney, Agent, or Firm*—Lane, Aitken, Dunner & Ziems

[57] ABSTRACT

Particles of perfectly spherical shape are produced within a vacuum-tight furnace chamber of small size by means of a movably mounted screen for stopping the particles discharged from a molten zone of an ingot which is driven in rotation at high speed. The rigid screen is formed of material having high thermal conductivity and is provided with a consumable coating on the surface which is struck by the particles. The coating is capable of producing a vapor atmosphere around the point of impact so as to modify the interfacial surface tension of the particles on the screen by means of a localized process of calefaction.

9 Claims, 3 Drawing Figures

FURNACE FOR THE PRODUCTION OF SPHERICAL PARTICLES

This invention relates to a furnace for the production of spherical particles of a material having a high melting point such as metal or an alloy. Said particles are dispersed in a controlled atmosphere in the form of droplets from a molten zone which is formed in an ingot of said material and subjected to the action of centrifugal force. By rotating the molten zone of the ingot at high speed, said droplets are thus ejected and progressively undergo solidification as they travel along their path, thus resulting in the formation of uniform spherical particles, the diameter of which is a function of the surface tension of the molten material, of the speed of rotation and of the heating intensity applied to the molten zone.

Various designs of a furnace of this type are already known. In a typical form of construction, provision is made for an enclosed chamber in which the ingot of fusible material (placed in some cases within an open crucible) is carried by a spindle which is driven in rotation at high speed. Said ingot is subjected to a thermal effect of high intensity which produces a suitable molten zone on the end surface of the ingot. The droplets thus produced are collected within the chamber after cooling and solidification by means of a suitably adapted recovery device which is generally cooled and permits storage of said particles. Melting of the ingot can be carried out by any known method, especially by means of a plasma torch, an electric arc or an electron beam derived from an electron bombardment gun, the chamber being necessarily placed in a vacuum in the case last mentioned. By way of example, a furnace of this type was described in French patent No. 1,382,998 granted to Commissariat a l'Energie Atomique. This patent illustrated in installation in which melting of the material was more especially performed by means of a plasma-arc torch.

In all known solutions, the production of perfectly spherical particles in fact entails the need to collect these latter only at the end of an unobstructed path and after a time of flight of sufficiently long duration to ensure that solidification of the molten material is as complete as possible in order to prevent deformations of said particles as well as damage to the recovery device which is associated with the furnace chamber. It is immediately apparent, however, that the chamber must be of extremely large size in order to satisfy such a requirement, especially if the droplets issuing from the molten zone have a flat trajectory by reason of a high speed of rotation which is essential for the production of particles of very small diameter. Moreover, in the event of melting of the material by the electron bombardment process which entails the creation of a high vacuum within the chamber, the trajectories of the particles are even longer, with the result that the requisite dimensions of the chamber are absolutely prohibitive. Conversely, the use of a chamber of smaller size but provided with an internal obstacle for stopping the particles during their trajectory usually causes flattening by compression to a greater or lesser degree as a result of impingement on said obstacle to which the particles may also adhere in some instances and the products obtained are far from being spherical in shape. In point of fact, the production of powders constituted by very small particles of perfectly spherical shape and having a diameter within the range of 100 to 200 microns, for example, offers remarkable advantages, especially in the sintering techniques employed in powder metallurgy. These powders have a higher packing coefficient, lower porosity and better homogeneity, which makes it possible in particular to ensure the achievement of improved operating conditions as well as appreciable reduction of waste material.

The present invention relates to a production furnace which employs a screen or like obstacle for stopping the particles issuing from a molten zone in the form of liquid droplets as a result of rotational displacement of said zone at high speed, thus permitting a considerable reduction in the dimensions of the furnace chamber. The furnace nevertheless permits the production of perfectly spherical balls, the screen being designed to permit absorption of the energy of said particles without producing appreciable deformations of these latter.

To this end, the furnace under consideration comprises a vacuum-tight chamber having a vertical axis, means for heating to the melting point an end zone on an ingot of fusible material supported by an adjustable spindle placed along the axis of the chamber and driven in rotation, a container attached to the chamber for the recovery and storage of particles ejected from the molten zone under the action of rotation of the spindle, and a rigid screen which is of revolution about the axis of the chamber and mounted within said chamber around the spindle in order to stop the particles derived from the molten zone prior to solidification of said particles. The furnace is distinguished by the fact that the screen is formed of material having high thermal conductivity and is provided with a consumable coating in that surface which receives the impact of the particles, said coating being capable of producing around the point of impact a vapor atmosphere which modifies the interfacial surface tension of the particles on the screen by means of a localized process of calefaction.

The particles which are derived from the molten zone, which have not yet been completely solidified and are therefore in a more or less plastic state thus encounter the rigid screen and produce a kind of local burn of small size on the coating of said screen while forming a thin vapor film which effectively isolates these particles from the material of the screen. In the first place, this permits practically total absorption of the kinetic energy of the particles and accordingly has the effect of considerably limiting the rebound energy of said particles which can fall freely to the bottom of the chamber in order to be recovered in the storage container. In the second place, the effect thereby achieved is to prevent any harmful deformation of said particles which practically retain their initial spherical shape.

Preferably, the rigid screen which is mounted within the chamber is cooled in the surface located opposite to that which carries the consumable coating, especially by a circulation of suitable cooling fluid within tubes which are welded or brazed onto the screen. Said screen is formed of metal having good conductivity such as copper or aluminum.

In accordance with a distinctive feature of the invention, the consumable coating of the rigid screen is formed of a resin, a lacquer or a carbonaceous varnish and more generally of a natural or synthetic polymer. In a preferred embodiment, the coating of the rigid screen is constituted by an aqueous solution of a coumarone resin mixed in a suitable proportion with an olein, with tall-oil and with triethanolamine.

The production of spherical particles which are discharged in liquid form from the molten zone of the ingot under the action of rotational motion of this latter and then progressively solidified especially at the time of impact on the screen takes place in a uniform manner. The vertical level of the molten zone along the axis of the chamber, especially at the focal point of the means adopted for heating the ingot is normally maintained constant by axial displacement of the spindle while supports said ingot. By reason of the "consumption" of the coating, there is consequently a danger that the region of impact of the particles on the rigid screen may no longer rapidly satisfy the requirements mentioned above as a result of early wear of said coating. In order to overcome this disadvantage and in accordance with a particular feature of the invention, the rigid screen is movably mounted within the chamber along the axis of this latter so as to displace the zone of impact of the particles. As an advantageous feature, the rigid screen is suspended from three vertical rods or cables which pass in vacuum-tight manner through a top end-wall which closes the chamber and are actuated in synchronous manner for the displacement of the screen. Depending on requirements, the displacement of the rigid screen within the chamber is either continuous or periodic.

Moreover and in accordance with another distinctive feature of the furnace under consideration, the rigid screen is associated in that surface which is opposite to the consumable coating with at least one electromagnetic hammer which is capable of producing within the screen vibrations of suitable frequency for detaching and removing any particles which may exceptionally have adhered to this latter.

Finally and in accordance with different alternative embodiments, the rigid screen is provided in the particle impact zone with a vertical cylindrical wall or with a conical wall which is inclined to the axis of the chamber in order to facilitate discharge of the particles to the storage container.

Further properties of a furnace for the production of spherical particles as constructed in accordance with the invention will become apparent from the following description of one example of construction which is given by way of indication and not in any limiting sense, reference being made to the accompanying drawings, wherein.

Figure 1:
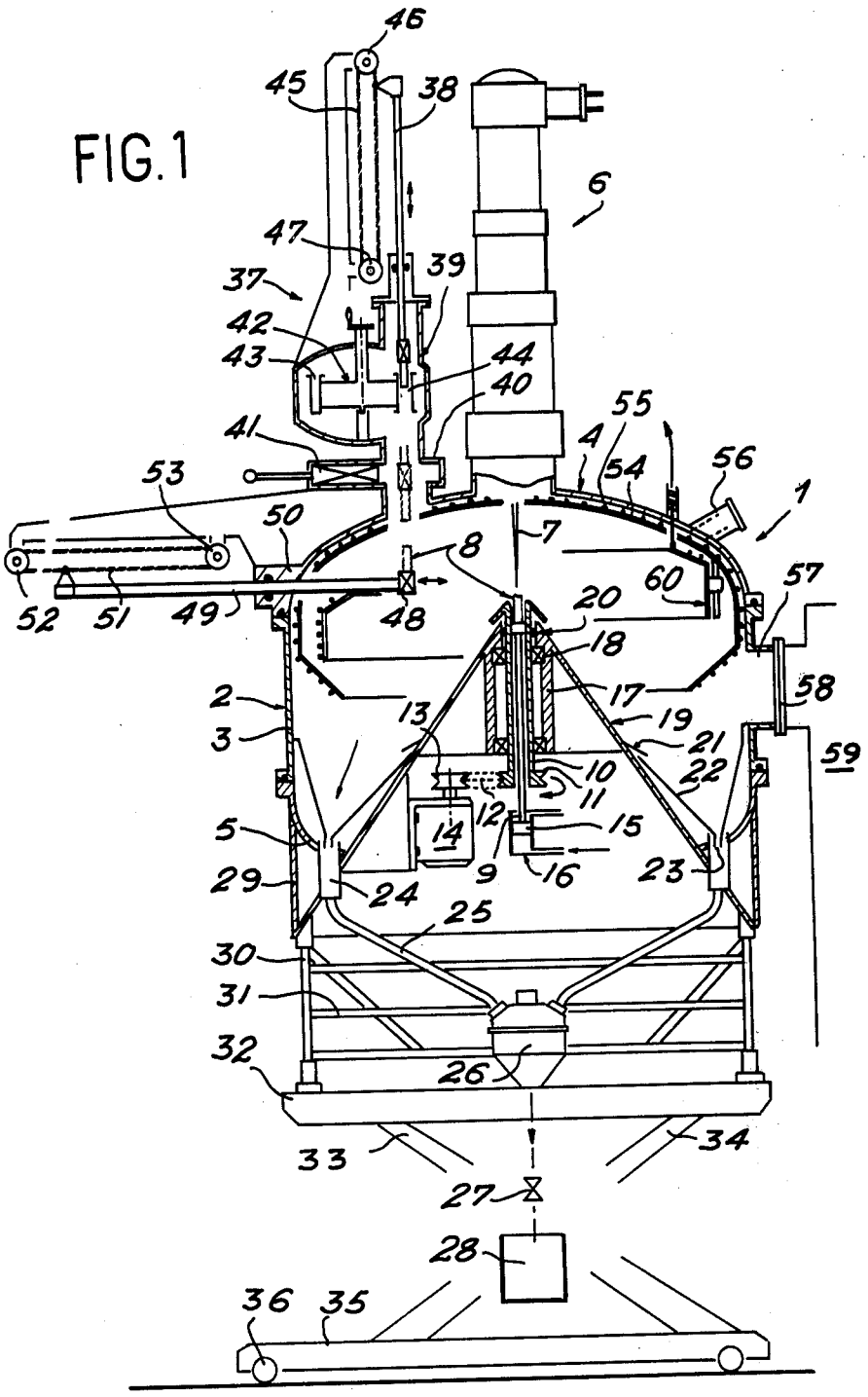
FIG. 1 is a diagrammatic vertical sectional view of the furnace under consideration.

In FIG. 1, the reference numeral 1 designates the production furnace as a whole. This furnace mainly comprises a chamber 2 constituted by a lateral cylindrical shell 3 having a vertical axis, said shell being closed both at the top and at the bottom by means of dished ends 4 and 5 respectively. The top end-wall 4 is associated along the axis of the chamber with an electron bombardment gun 6, the constructional detail of which has little bearing on the invention; said gun is adapted to deliver within the chamber 2 a suitably focused electron beam 7, the internal atmosphere of the chamber being maintained under a degree of vacuum which is necessary to sustain said beam. A molten zone which permits of continuous ejection of liquid droplets under the action of centrifugal force can be formed by means of said beam at the top portion of an ingot 8 of a material having a high melting point such as a metal or an alloy which it is desired to split up into spherical particles of very small diameter. To this end, the ingot 8 is mounted at the extremity of a rotary spindle 9 which is in turn disposed in the vertical axis of the chamber 2 within a coaxial sleeve 10 with which it is coupled for rotation. Said sleeve passes through the bottom end-wall 5 of the chamber and is provided at its lower end with a driving pulley 11 which cooperates with a belt 12, said belt being in turn engaged within the groove of a second pulley 13 which is driven by a motor 14. The spindle 9 is capable of sliding axially within the sleeve 10 independently of its movement of rotation with said sleeve, especially in order to ensure that the molten zone formed at the top portion of the ingot 8 is maintained at a substantially constant horizontal level, progressively as the discharge of droplets and the depletion of the material take place.

To this end, the lower portion of the spindle 9 is provided with a piston 15 which is capable of axial displacement within a casing 16 either under the action of a pneumatic system or by means of a mechanical drive system of the gear type (not shown in the drawings). The sleeve 10 which contains the spindle 9 is mounted outside the chamber 2 within a bearing shell 17 on ball-bearings 18 in such a manner as to ensure that the movement of rotation of said spindle can take place freely. The end of the sleeve 10 which surrounds the spindle 9 and the ingot 8 passes through the bottom end-wall 5 of the chamber 2 so as to penetrate into this latter through a protective casing 19, leak-tight penetration of said casing being ensured by means of seals 20. Within the interior of the chamber 2, the spherical particles produced by the molten zone of the ingot 8 and discharged from said zone under the action of rotation of the spindle 9 are recovered after solidification by means of deflecting fins 21. As will be explained below, said particles fall freely onto said deflecting fins in order to collect in the bottom portion of the chamber through a funnel 22 of annular shape having discharge openings 23 which cooperate with a receiving hopper 24 located outside the chamber, said hopper being connected by means of pipes 25 to a storage container 26. Finally, said container communicates by means of a control valve 27 with a transport flask 28 which is placed beneath the chamber. Said chamber is advantageously supported by a movable bottom section 29 carried by a support structure formed of tie-bolts 30 which are braced by means of horizontal arms 31. The complete assembly rests on a platform 32 carried by sloping arms 33 and 34 which form part of a carriage 35, said carriage being capable of moving along the ground by means of wheels 36 so as to position the chamber at a suitable work station.

The introduction of an ingot 8 within the interior of the chamber 2, especially for positioning said ingot at the end of the rotary spindle 9, is carried out in the example described in the foregoing by means of two jointly operated and remotely controlled mechanisms which are illustrated diagrammatically in FIG. 1. One of these mechanisms which is designated by the reference numeral 37 is mounted on the top end-wall 4 and comprises a vertical tong-unit 38 which is capable of moving within the interior of a sealed casing 39. A connecting lock-chamber 40 serves to establish a communication between said casing 39 and the chamber 2 through a slide-valve 41 which makes it possible to ioslate the lock-chamber 40 in order to maintain the necessary vacuum during a period of operation of the electron gun 6. The casing 29 is provided internally with a rotary-drum magazine 42 having a vertical axis, provision being made within said drum for a series of compartments 43 each adapted to carry one or a number of ingots to be melted within the chamber and a passage 44 for the tong-unit 38. After an ingot 8 has been taken from one of the compartments 43 by the tong-unit 38, said ingot is introduced into the chamber after suitable rotation of the drum, transferred through said drum and then through the lock-chamber 40 while the slide-valve 41 is held in the open position. The vertical displacement of the tong-unit 38 is carried out by means of a cable 45 passed in a closed loop over two pulleys 46 and 47 respectively, one of which is actuated by means of a motor (not shown in the drawings). At the end of downward travel, the tong-unit 38 places the ingot within the jaws of a second tong-unit 48, this latter being mounted at the extremity of a transverse arm 49 which passes in vacuum-tight manner through the wall of the chamber 2. Said arm 49 is in turn capable of carrying out a movement of displacement in a direction parallel to itself under the action of a second cable 51 which cooperates with two pulleys 52 and 53 so as to bring the ingot onto the extremity of the rotary spindle 9, especially whenever a previous ingot is totally depleted as a result of the melting process produced by the electron beam 7.

Finally, the equipment of the chamber 2 is completed by means of a bell-housing 54 which lines the internal surface of the top end-wall 4 and if necessary the upper extremity of the lateral shell 3. Said bell-housing 54 makes it possible to ensure suitable cooling of the chamber by means of circulating tubes 55 which are brazed or welded onto its external surface and through which a suitable cooling fluid is circulated. The chamber is also provided with penetrations for nozzles 56 (only one nozzle being shown in the drawings) which permit visual inspection of melting of the ingot under the action of the electron beam. Finally, the lateral wall 3 is provided with a nozzle 57 connected by means of a coupling-flange 58 to a diffusion pump 59 in order to create within the chamber the degree of vacuum which is necessary for propagation of the electron beam 7.

Figure 2:
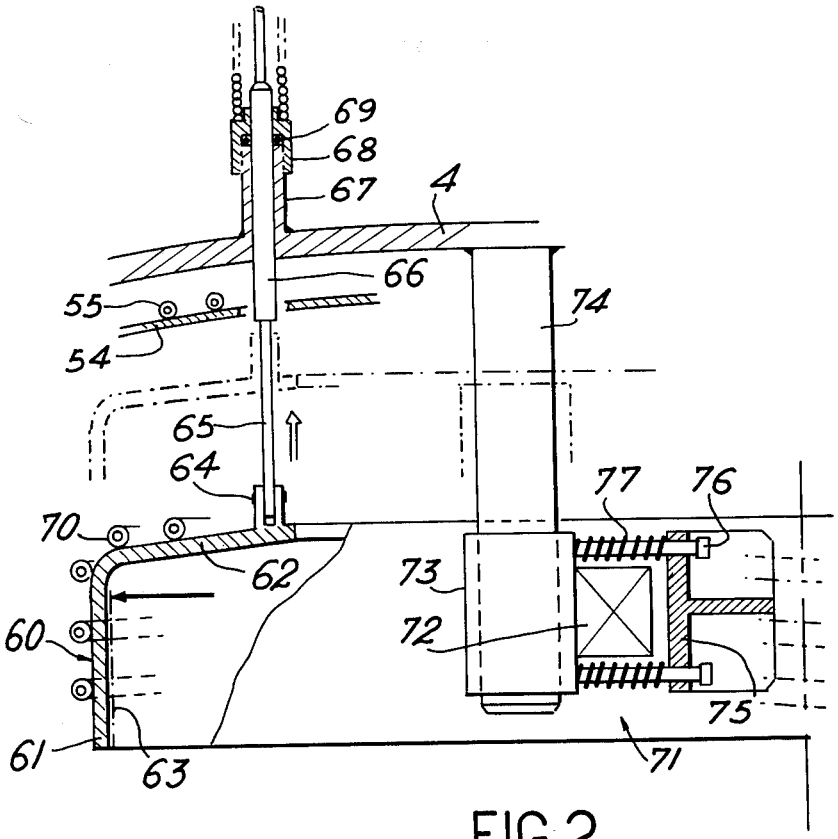
FIG. 2 is a detail view of the rigid screen employed in the furnace shown in FIG. 1.
Figure 3:
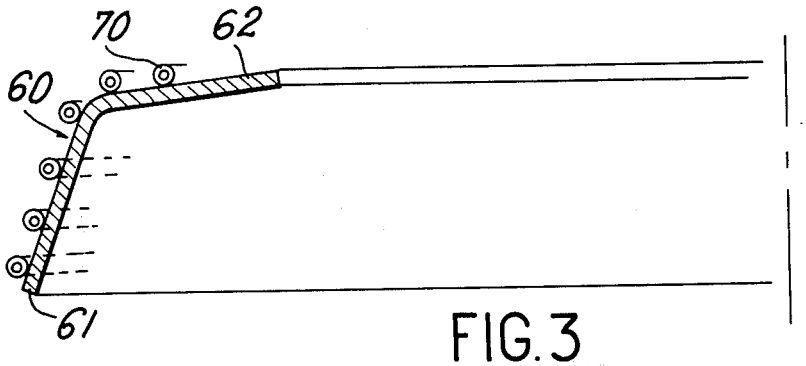
FIG. 3 illustrates another alternative form of construction of the rigid screen.

In accordance with the invention, the chamber 2 is also provided with a movable screen 60 placed on the path of the droplets which are discharged from the ingot 8 under the action of rotational motion of the spindle 9, the constructional detail of said screen 60 being explained more especially with reference to FIGS. 2 and 3.

As shown in particular in FIG. 2, the screen 60 is made up of two main parts, in particular of a lateral skirt 61 which is cylindrical and of revolution about the axis of the chamber in the example of construction shown in this figure. The top portion of said skirt 61 is joined to a slightly dished top end-wall 62. In accordance with the invention, provision is made on the internal surface of the screen 60 and especially within the skirt 61 of this latter for a coating 63 of consumable material having a small thickness of the order of a few microns. Said material is selected so as to ensure not only that the particles impinging upon the skirt are not contaminated but that their interfacial surface tension is considerably modified while producing calefaction of the coating material at the point of impact in a vaporized zone of very small area, thereby achieving veritable isolation of said particles from the screen itself. Said screen is preferentially formed of material having a high coefficient of thermal conductivity such as copper or aluminum so as to ensure that the evolution of heat which is produced by the impact of the particles not only serves to vaporize the coating but, in addition, is diffused almost instantaneously through the surface of the screen.

The coating on the rigid screen which thus absorbs the energy of the particles is constituted by a natural or synthetic polymer and especially by a carbonaceous resin, a varnish or a lacquer. It can be mentioned soley by way of indication that said coating can be constituted by a mixture in aqueous solution of a thermoplastic coumarone resin (residue extracted from coal tar), of olein, of tall-oil and of triethanolamine.

The impact of the particles against the coating 63 thus results in progressive consumption of this latter. It is therefore necessary to carry out displacement of the impact zone progressively as melting of the ingot takes place. To this end, the top end-wall 62 of the screen 60 has three bearing-brackets 64 for attaching vertical traction rods 65 which are spaced at intervals about the axis of the chamber 2. Said rods 65 are secured at their opposite ends to an end-piece 66 which traverses the top end-wall 4 of the chamber 2 through sleeves 67, each sleeve being covered by an end-cap 68 which imprisons a seal 69. Finally, the external surface of the screen is fitted with tubes 70 through which a suitable coolant is circulated in order to achieve an even greater improvement in the cooling and solidification of the particles which impinge on the screen.

In order to prevent any particles which may exceptionally have been flattened against the wall of the screen from adhering to this latter and forming veritable agglomeration points to which subsequent particles would also adhere and which would be detrimental to the formation of perfectly spherical balls, the skirt 61 of the screen is associated in that surface which is opposite to the coating 63 with a series of vibratory hammers 71 of an electromagnetic type or the like. Each hammer can be constructed as shown in FIG. 2 by means of an electromagnet 72 carried by a support 73 which is fixed on the end of a column 74. Application of voltage to said electromagnet results in the attraction of a magnetic metal member 75 which is fixed on the external surface of the screen 60. Springs 76 guided on rods 77 perform the function of damping devices.

In the example of construction shown in FIG. 2, the skirt 61 of the screen 60 is cylindrical and has an axis which coincides with that of the chamber. Other alternative forms could naturally be contemplated such as in particular the design illustrated diagrammatically in FIG. 3 in which the skirt 61 is inclined to the horizontal and has the shape of a conical portion joined to the end-wall 62. In the case of some materials, this alternative form can facilitate the discharge of particles after impact on the coating 63, the rebound energy being of very low value in all cases so as to enable said particles to fall freely before being recovered by the annular funnel 22 and collected within the storage container 26 (shown in FIG. 1).

The furnace which is thus provided for the production of spherical particles and has small transverse dimensions makes it possible to obtain spheres which are perfectly uniform and homogeneous. By way of indication, in the case of supercarburized steels or nickel-base superalloys or else titanium alloys, 90% of the powdered material is of strictly spherical shape. Accordingly, the powders obtained lend themselves more readily to many conversion operations and especially to sintering. It is worthy of note that, in some cases, it may prove useful to obtain particles which are not precisely spherical but have a slightly flattened shape. In such a case the furnace chamber can be employed just as effectively by dispensing with an internal coating on the inner movable screen. The resultant rapid cooling in contact with the screen is sufficient to obtain extremely fine crystallization of the particles, this feature being of interest in certain other applications.

As can readily be understood, the invention is not limited to the example of construction which has been described in the foregoing with reference to the accompanying drawings but extends on the contrary to all alternative forms.

We claim:

1. A furnace for the production of spherical particles comprising a vacuum-tight chamber having a vertical axis, means for heating to the melting point an end zone on an ingot of fusible material supported by an adjustable spindle placed along the axis of the chamber and driven in rotation, a container attached to the chamber for the recovery and storage of particles ejected from the molten zone under the action of rotation of the spindle, and a rigid screen which is of revolution about the axis of the chamber and mounted within said chamber around the spindle in order to stop the particles derived from the molten zone prior to solidification of said particles, wherein the screen is formed of material having high thermal conductivity and is provided with a consumable coating in that surface which receives the impact of the particles, said coating being capable of producing around the point of impact a vapor atmosphere which modifies the interfacial surface tension of the particles on the screen by means of a localized process of calefaction.

2. A production furnace according to claim 1, wherein the rigid screen which is mounted within the chamber is cooled in the surface located opposite to that which carries the consumable coating by means of a circulation of suitable cooling fluid within tubes which are welded or brazed onto said screen.

3. A production furnace according to claim 1, wherein the rigid screen is formed of metal having good conductivity such as copper or aluminum.

4. A production furnace according to claim 1, wherein the consumable coating of the rigid screen is formed of a resin, a lacquer or a carbonaceous varnish and more generally of a natural or synthetic polymer.

5. A production furnace according to claim 4, wherein the coating of the rigid screen is constituted by an aqueous solution of a coumarone resin mixed in a suitable proportion with an olein, with tall-oil and with triethanolamine.

6. A production furnace according to claim 1, wherein the rigid screen is movable mounted within the chamber along the axis thereof so as to displace the zone of impact of the particles.

7. A production furnace according to claim 6, wherein the rigid screen is suspended from three vertical rods or cables which pass in vacuum-tight manner through a top end-wall which closes the chamber and are actuated in synchronous manner for the displacement of the screen.

8. A production furnace according to claim 1, wherein the rigid screen is associated in that surface which is opposite to the consumable coating with at least one elctromagnetic hammer which is capable of producing within the screen vibrations of suitable frequency for detaching and removing any particles which may exceptionally have adhered to said screen.

9. A production furnace according to claim 1, wherein the rigid screen is provided in the particle impact zone with a vertical cylindrical wall or with a conical wall which is inclined to the axis of the chamber.

* * * * *